United States Patent [19]

Buchanan et al.

[11] Patent Number: 4,601,400

[45] Date of Patent: Jul. 22, 1986

[54] HOLDER FOR KNIVES AND THE LIKE

[75] Inventors: Delbert L. Buchanan, Lake Oswego, Oreg.; Keith W. Buchanan, Fairbanks, Ak.

[73] Assignee: Buchanan Industries, Lake Oswego, Oreg.

[21] Appl. No.: 531,261

[22] Filed: Sep. 12, 1983

[51] Int. Cl.[4] ..... A47F 7/00

[52] U.S. Cl. ..... 211/70.7; 312/204

[58] Field of Search ..... 211/60 T; 248/37.3, 248/37.6; 312/204, 206; 206/553; 30/296 A

[56] References Cited

U.S. PATENT DOCUMENTS

| | | | |
|---|---|---|---|
| 2,488,035 | 11/1949 | Pistone | 312/204 |
| 2,505,510 | 4/1950 | Vermillion | 206/553 X |
| 2,563,733 | 8/1951 | Meczelski | 312/206 X |
| 4,082,386 | 4/1978 | Beasley, Jr. | 312/204 |
| 4,423,552 | 1/1984 | Bourgein et al. | 248/37.3 |

FOREIGN PATENT DOCUMENTS

| | | | |
|---|---|---|---|
| 1506496 | 11/1967 | France | 312/206 |

*Primary Examiner*—Ramon S. Britts
*Assistant Examiner*—Sarah A. Lechok
*Attorney, Agent, or Firm*—Jack E. Day

[57] ABSTRACT

The present invention provides a novel holder for knives or other utensils which tilts forward to present the handles to a prospective user, making it easier, safer, and more convenient to withdraw the utensils from their place of storage.

4 Claims, 7 Drawing Figures

HOLDER FOR KNIVES AND THE LIKE

BACKGROUND OF THE INVENTION

This invention relates to convenience holders for tools and instruments in general, and to tilt-forward holders for knives and the like, in particular.

There have been many past efforts to develop holders for sets of knives and other tools and instruments which present the handles of the instruments so that they are convenient and safe to select, grasp and withdraw for use, and reinsert in the holder. An early example is disclosed in Hopkins U.S. Pat. No. 2,238,324, wherein a shaped, block-like body has slots therein to receive the blades of several knives so that the handles are upright and somewhat separated, as the holder is mounted on a vertical surface. A related holder is disclosed in U.S. Pat. No. 2,157,412, issued to the same inventor.

Rosenberg U.S. Pat. No. 2,338,303 discloses a knife-holder which is of relatively thin material disposed in a horizontal planar surface, with slots therein for the blades to hang through. The blades are covered by a removable cover, which may be transparent, and the unit is constructed to hang on a vertical surface.

Hain et al U.S. Pat. No. 3,486,610 discloses a cabinet-like knife holder for hanging on a vertical surface and having a hinged cover for closing when the knives are not being used. The knives are held in place by magnetized strips fastened horizontally to the cabinet rear wall.

Horix U.S. Pat. No. 1,719,840 discloses a container for stationery and the like, which features a holder for a writing instrument which is spring-loaded so that when the cover is opened, the handle of the writing instrument is propelled upward into a convenient position to be grasped by the user.

Anderson et al U.S. Pat. No. 2,589,593 discloses a case for storing drill bits, having holders therefor which tilt outward when the case is opened.

Seta U.S. Pat. No. 3,124,399 discloses a toothbrush holder which normally holds the brushes in an upright position until they are to be used, at which time they are tilted forward to facilitate withdrawal and use.

Le Sueur et al U.S. Pat. No. 3,309,159 discloses a toothbrush holder in which the brushes are mounted on a bracket fastened to the backside of the access door. As the door is tilted forward to gain access to the brushes, the brushes are also tilted forward to more conveniently present the brushes for selection and withdrawal. They cabinet has a stop mechanism to prevent the access door from being tilted more than is desirable.

SUMMARY OF THE INVENTION

The present invention provides a novel holder for knives or other utensils which tilts forward to present the handles to the prospective user, making it easier, safer, and more convenient to withdraw the utensils from their place of storage. The holder is simple, economical, and effective, and overcomes the shortcomings of existing holders.

The holder basically comprises a storage member containing slots therein, into which the blades of the knives are inserted. The holder is hinged or pivoted at the bottom end, permitting it to tilt forward toward the user, thus presenting the handles so that they are easier to grasp. The forward tilt of the storage member is limited by a restraining member which engages limiting elements incorporated in the structure. The forward tilt of the storage member depends upon where the holder is to be placed. For example, in a holder mounted on the wall of a cabinet, or one sitting on a counter, the tilt need be only about 15°, more or less, while a holder mounted under a cabinet might need to tilt 45° to 60° or more to enable the handles to clear the edge of the cabinet. The restraining member, or a portion of it, also acts to close the gap that would otherwise open when the storage member is tilted forward and thus prevents objects and dirt from falling into said gap. The restraining member is hingedly fastened, either directly or indirectly, to the storage member.

It will be understood by those skilled in the art that the novel holder herein described and claimed can be free-standing or could be mounted on a vertical surface such as a wall, cabinet side or door, and that it can be open or enclosed within a cabinet with doors, without departing from the spirit or intent of the invention.

It is, therefore, a principal object of the invention to provide a holder for knives and other tools and instruments which presents the handles to the user in a manner in which they are easier to grasp and withdraw than heretofore.

It is a further object of the present invention to provide a holder for knives and the like which is more convenient to use than existing holders.

It is a still further object of the present invention to provide a holder for knives and other utensils which makes it easier to withdraw such instruments from their places of storage.

It is yet another object of the present invention to provide a holder for knives and other tools and instruments which does not have a gap behind the tool holder for objects and dirt to fall into when the holder is pulled forward for use.

These and other objectives, features and advantages of the present invention will be more readily understood upon consideration of the following detailed description of the invention taken in conjunction with the accompanying drawings.

DETAILED DESCRIPTION OF THE PRESENT INVENTION

Figure 1:
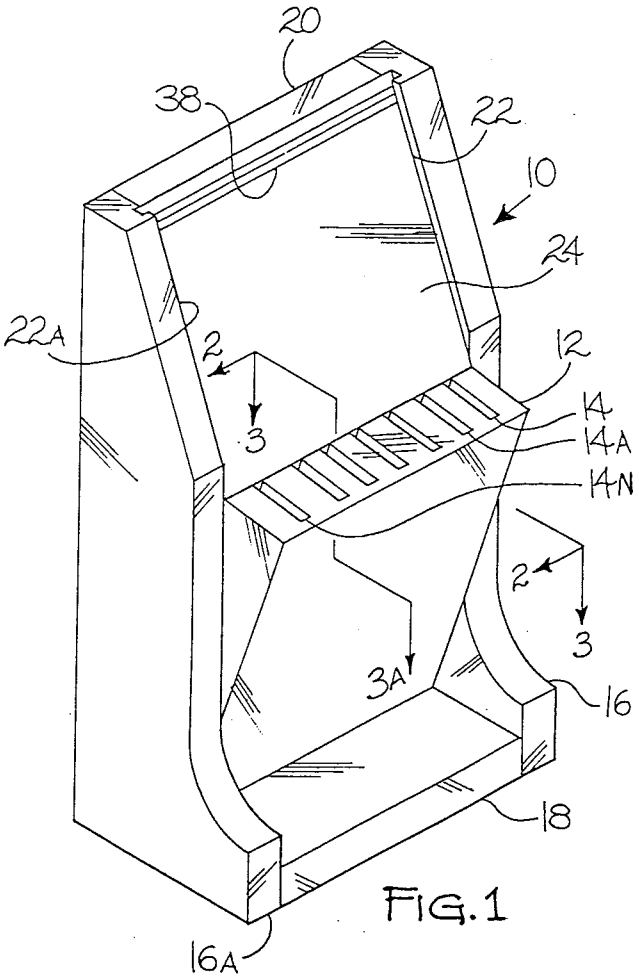
FIG. 1 is an oblique perspective view of the present invention in a free-standing form.

Turning now to FIG. 1, we see the present invention 10, having a knife-holder 12 therein, with multiple slots 14, 14*a* . . . 14*n*, for holding a multiplicity of knives or other instruments, tools and the like. The holder 12 is pivoted at the bottom in a manner hereinafter more completely described. A base member 18 and a back plate 20 complete the basic structure of the holder.

The knife-holder 12 tilts forward to present the handles in a more convenient manner for grasping and withdrawing than is available from conventional knife-holders. The side members 16 and 16*a* have fabricated into them means for limiting the forward tilt of knife-holder 12, as is explained in more detail hereinafter, in connection with FIGS. 2–2B, 3 and 3A.

Figure 2B:
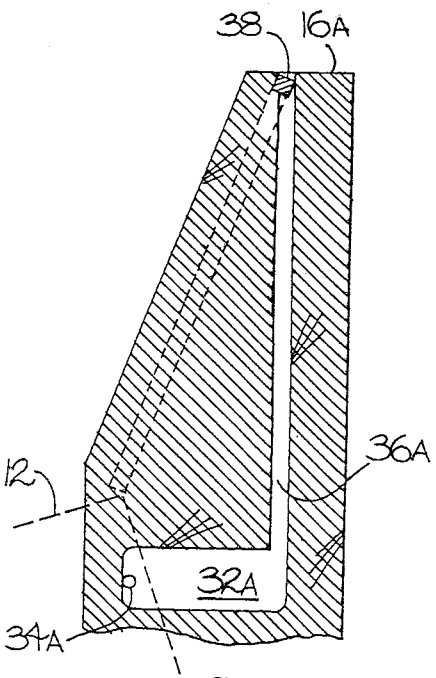
FIG. 2B is a view of an alternate structure of the limiting elements.
Figure 2A:
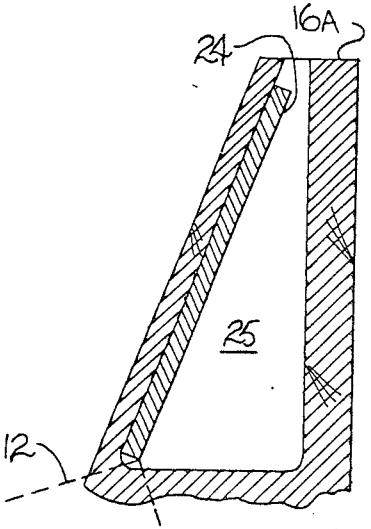
FIG. 2A is a view of the interior of the upper portion of the of the side member, disclosing one structure of the limiting elements.
Figure 2:
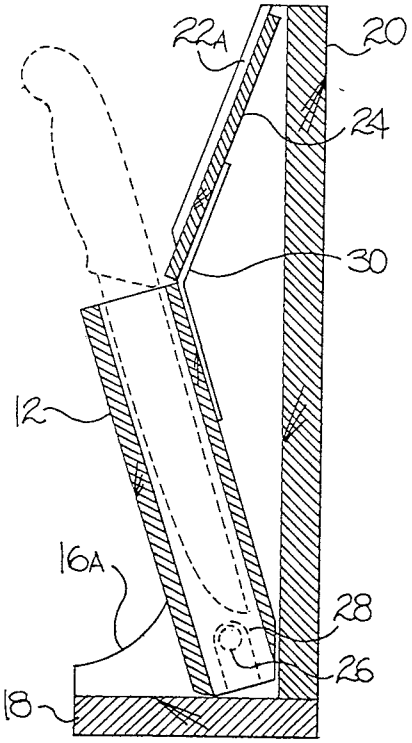
FIG. 2 is a view in vertical section of the invention, taken along the plane indicated by the arrows "2—2" of FIG. 1.
Figure 3:
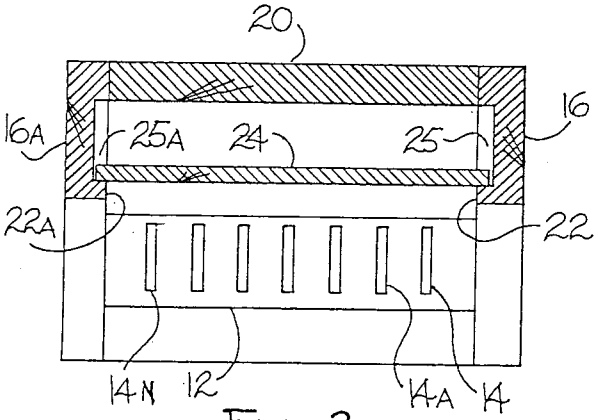
FIG. 3 is a view in cross-section of the invention, taken along the plane indicated by the arrows "3—3" of FIG. 1.

Turning now to FIG. 2, we see how the tilting forward of holder 12 facilitates the grasping of the knife handles, seen in dotted outline. Lip 22*a* overlays restraining element 24, preventing holder 12 from tilting more than a desired amount, depending upon the location for which the invention is designed. We also see from FIG. 2 how member 24 acts to cover the gap that appears between holder 12 and back plate member 20. Holder 12 is pivoted on cylindrical pegs 26, which are pressed into matching holes in side members 16 and 16*a*, and which project into notches 28 fabricated into the sides of holder member 12. It can be seen that as the holder 12 tilts forward, member 24 encounters or engages lips 22 and 22*a*, thereby limiting the amount of forward tilt. FIGS. 2A and 3 disclose this structure in somewhat more detail. It will be understood by those skilled in the art that the corners of the lower edge of member 24, where it is attached to holder 12 by hinge 30, will have small notches cut into them (not shown) in order to permit member 24 to project beyond the lower end of lips 22 and 22*a*, as seen in FIG. 2. As seen in FIG. 2A, the cavity 25 is fabricated, milled, molded or otherwise formed into side member 16 and 16*a*.

Figure 3A:
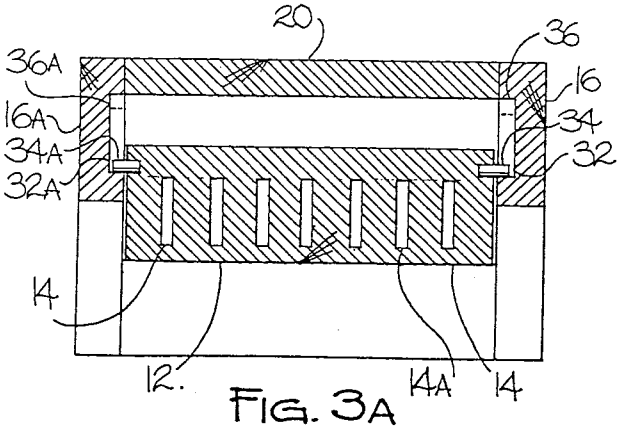
FIG. 3A is a view in cross-section of another form of the limiting means, taken along the plane indicated by the arrows "3—3A" of FIG. 1.

FIGS. 2B and 3A disclose an alternate method of forming limiting means, in order to permit the holder 12 to tilt further forward. The holder 12 has inserted into its upper rear corners cylindrical pegs 34 and 34*a* which engage the walls of cavities 32 and 32*a* fabricated into the sides 16 and 16*a*. The slots 36 and 36*a* are formed as a part of cavities 32 and 32*a* to aid in assembly and to provide a channel for restraining element 38 to slide in. Element 38 is fabricated to the top of restraining member 24 in this alternate design.

Figure 4:
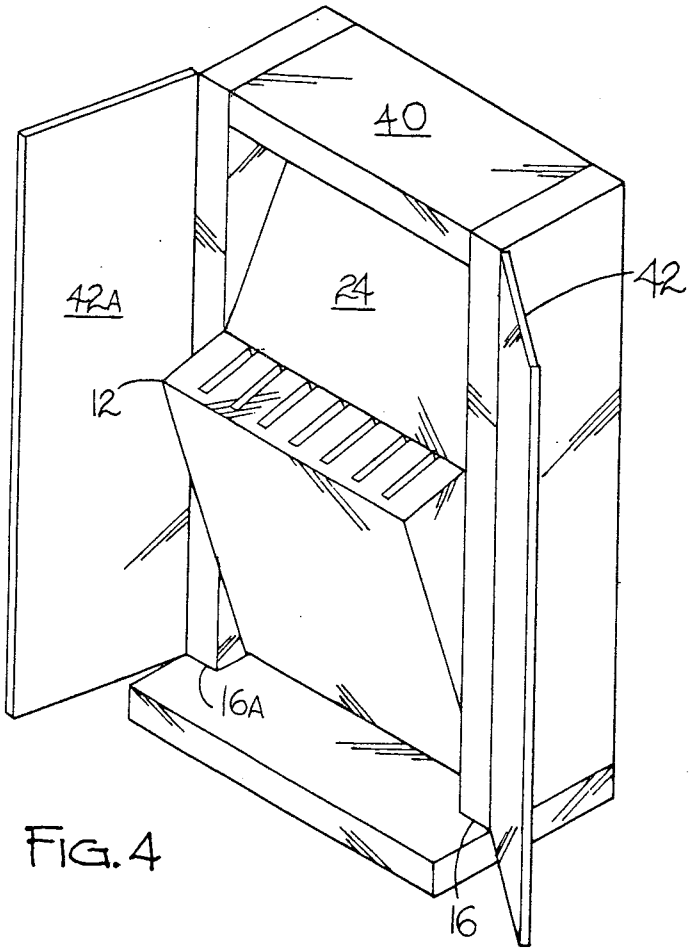
FIG. 4 is an oblique perspective view of the invention, in an alternate form with doors.

FIG. 4 discloses an alternative form of the present invention 10, modified to be a small cabinet, with top plate 40 completing a case and the doors 42 and 42*a* providing concealment of the knives or other utensils stored within.

It will be understood, by those skilled in the art, that the form of the invention as shown in FIGS. 1 and 4, can be modified in order that it could be mounted on a vertical surface such as a wall, cabinet or door. In such a case, the base member 18 could be omitted and the lower portion of side members 16 and 16*a* could be suitably modified for appearance.

It will be further understood that the invention heretofore described can be fabricated of many materials such as wood, plastic, metal and the like, and in many forms, without departing from the spirit or intent of the invention. For example, limiting means as disclosed in FIGS. 2B and 3A permits the invention to be mounted under a cabinet, simply by locating cavities 32 and 32*a* farther down the sides 16 and 16*a*, and suitably moving the location of pegs 34 and 34*a*. It will be understood that holder 12 will then be able to tilt forward to 45° or even 60°, to permit the handle of the knives to clear any overhanging cabinets.

The terms and expressions which have been employed in the foregoing specification are used therein as terms of description and not of limitation, and there is no intention, in the use of such terms and expressions of excluding equivalents of the features shown and described or portions thereof, it being recognized that the scope of the invention is define and limited only be the claims which follow.

What we claim as our invention is:

1. In a storage apparatus for knives and the like having a handle and a blade, said apparatus having a holder member with a top end and a bottom end, said top end having slots therein for receiving said blade and holding said knives in vertical rest position with said handle projecting upwardly from said holder member, the improvement comprising:

a. means pivotally connecting said bottom end to said apparatus, enabling said holder member rotatably to tilt forward from said vertical rest position;

b. means arresting said forwardly rotatable tilt at an angle enabling said handle easily to be grasped and said knives to be withdrawn, and including:

1. said apparatus having side members with forwardly extending grooves therein, said grooves ending short of the front surface of said side member;

2. said holder members having side surfaces with projections therefrom to slidingly matingly engage said grooves; and 3. said forwardly rotatable tilt of said holder member being arrested by the engagement of said groove endings by said projections. --

2. In a storage apparatus for knives and the like having a handle and a blade, said apparatus having a holder member with a top end and a bottom end, said top end having slots therein for receiving said blade and holding said knives in vertical rest position with said handle projecting upwardly from said holder member, the improvement comprising:

a. means pivotally connecting said bottom end to said apparatus, enabling said holder member rotatably to tilt forwardly from said vertical rest position, and including:

1. said apparatus having side members with projections therefrom at said bottom end projecting inwardly toward one another along a common axis;

2. said holder member having said surfaces thereon with notches therein at said bottom end thereof, said notches rotatably engaging said projections;

b. means arresting said forwardly rotatable tilt at an angle enabling said handle easily to be grasped and said knives to be withdrawn, and including:

1. said side members having forwardly extending grooves therein, said grooves ending short of the front surface of said side members;

2. said holder member having side surfaces with second projections therefrom to slidingly matingly engage said grooves; and 3. said forwardly rotatable tilt of said holder member being arrested by the engagement of said groove endings by said second projections.

3. In a storage apparatus for knives and the like having a handle and a blade, said apparatus having a holder member with a top end and a bottom end, said top end having slots therein for receiving said blade and holding said knives in vertical rest position with said handles projecting upwardly from said holder member, the improvement comprising:

a. means pivotally connecting said bottom end to said apparatus, enabling said holder member rotatably to tilt forwardly from said vertical rest position;

b. means arresting said forwardly rotatable tilt at an angle enabling said handle easily to be grasped and said knives to be withdrawn, and including:

1. said apparatus having side members with a wedge-shaped cavity therein, the front edge of said wedge-shaped cavity forming an over-lapping lip;

2. cover means pivotally connected to said top end of said holder means, said cover means extending transversely at least partially into said wedge-shaped cavity; and 3. said over-lapping lip engaging said cover means whenever said holder member rotatably tilts forwardly, and arresting said forward tilt thereat.

4. In a storage apparatus for knives and the like having a handle and a blade, said apparatus having a holder member with a top end and a bottom end, said top end having slots therein for receiving said blade and holding said knives in vertical rest position with said handle projecting upwardly from said holder member, the improvement comprising:

a. means pivotally connecting said bottom end to said apparatus, enabling said holder member rotatably to tilt forwardly form said vertical rest position, including:

1. said apparatus having side members with projections therefrom at said bottom end thereof projecting inwardly toward one another along a common axis;

2. said holder member having side surfaces thereon with notches therein at said bottom end thereof, said notches rotatably engaging said projections;

b. means arresting said forwardly rotatable tilt at an angle enabling said handle easily to be grasped and said knives to be withdrawn, and including:

1. said side members having a wedge-shaped cavity therein, the front edge of said wedge-shaped cavity forming an over-lapping lip;

2. cover means pivotally connected to said top end of said holder means and extending transversely at least partially into said wedge-shaped cavity; and 3. said over-lapping lip engaging said cover means whenever said holder member rotatably tilts forwardly, and arresting said forward tilt thereat.

* * * * *